US009467759B2

(12) United States Patent
Cai et al.

(10) Patent No.: US 9,467,759 B2
(45) Date of Patent: Oct. 11, 2016

(54) SPEAKER BOX

(71) Applicants: Bin Cai, Shenzhen (CN); Bo Xiao, Shenzhen (CN)

(72) Inventors: Bin Cai, Shenzhen (CN); Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 14/525,428

(22) Filed: Oct. 28, 2014

(65) Prior Publication Data

US 2016/0021447 A1 Jan. 21, 2016

(30) Foreign Application Priority Data

Jul. 18, 2014 (CN) ..... 2014 2 0401846 U

(51) Int. Cl.

| | |
|---|---|
| ***H04R 9/06*** | (2006.01) |
| ***H04R 1/02*** | (2006.01) |
| ***H04R 9/04*** | (2006.01) |
| ***H04R 9/02*** | (2006.01) |

(52) U.S. Cl.

CPC ..... *H04R 1/025* (2013.01); *H04R 1/021* (2013.01); *H04R 9/025* (2013.01); *H04R 9/045* (2013.01); *H04R 9/06* (2013.01); *H04R 2201/02* (2013.01); *H04R 2400/11* (2013.01); *H04R 2499/11* (2013.01)

(58) Field of Classification Search

CPC ..... H04R 1/02; H04R 1/021; H04R 1/025; H04R 1/345; H04R 7/04; H04R 7/20; H04R 9/025; H04R 9/06; H04R 2201/02; H04R 2499/11; H04R 2499/15; H04R 9/046; H04R 2400/11

USPC ..... 381/332, 334, 335, 345, 386, 396, 412, 381/419, 420, 431, 400, 408; 181/199; 379/430, 433.02, 432

See application file for complete search history.

(56) References Cited

U.S. PATENT DOCUMENTS

| | | | | |
|---|---|---|---|---|
| 5,664,024 A * | 9/1997 | Furuta | H04R 7/127 381/396 |
| 6,594,372 B2 * | 7/2003 | Nakaso | H04R 7/127 381/396 |
| 2007/0076915 A1 * | 4/2007 | Shin | H04R 7/04 381/400 |
| 2012/0008810 A1 * | 1/2012 | Lu | H04R 1/021 381/332 |

* cited by examiner

*Primary Examiner* — Huyen D Le
(74) *Attorney, Agent, or Firm* — Na Xu; IPro, PLLC

(57) ABSTRACT

A speaker box is disclosed. The speaker box includes a housing including a bottom wall, and a speaker unit accommodated in the housing. The speaker unit includes a magnetic circuit unit having a lower plate, a magnet on the lower plate, an upper plate on the magnet, and a magnetic gap. The lower plate abuts against the bottom wall for forming a space communicated with the magnetic gap. Thus, the air pressure in the magnetic gap is balanced, and the low frequency sound performance is improved.

11 Claims, 4 Drawing Sheets

SPEAKER BOX

FIELD OF THE INVENTION

The present invention relates to electroacoustic apparatuses, more particularly to a speaker box having leaking holes.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speaker-boxes have been developed. An speaker-box is generally coupled to an audio equipment or an amplifier for use as a large sound producing means for considerably amplifying volume. Alternatively, the speaker-box may be used as a small sound producing means having a small size and volume.

An electronic device, such as a cellular phone, a camcorder, a PDA, a digital camera, or a notebook computer, provides a space for accommodating a speaker-box therein. Nowadays, a speaker-box with high quality audio performance and miniature size is desired by the user for enjoying high performance voices or entertainment contents.

A speaker-box related to the present application comprises a case, and a speaker unit accommodated in the case. The speaker unit comprises a magnetic circuit part having a yoke positioned in the case, a pole plate and a magnet disposed in the yoke, a diaphragm supported by the case, a voice coil directly or indirectly attached to the diaphragm, and a cover pressing on a peripheral portion of the diaphragm. The case and the cover corporately define a cavity. For electrically connecting the speaker-box to an external PCB, a plurality of terminals is provided and is connected to leads of the voice coil. When alternating currents go through the voice coil, the magnet will drive the voice coil to vibrate and the diaphragm will also vibrate with the voice coil accordingly, which converts the currents into sound waves.

When the speaker unit is received in the case, sides of the speaker unit is sealed by the case. The inside of the speaker unit cannot be communicated with the outside of the speaker unit, which badly affect the acoustic performance of the speaker unit.

Accordingly, an improved silicon condenser microphone which can overcome the disadvantage described above is desired.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

The present invention will hereinafter be described in detail with reference to exemplary embodiments.

Figure 1:
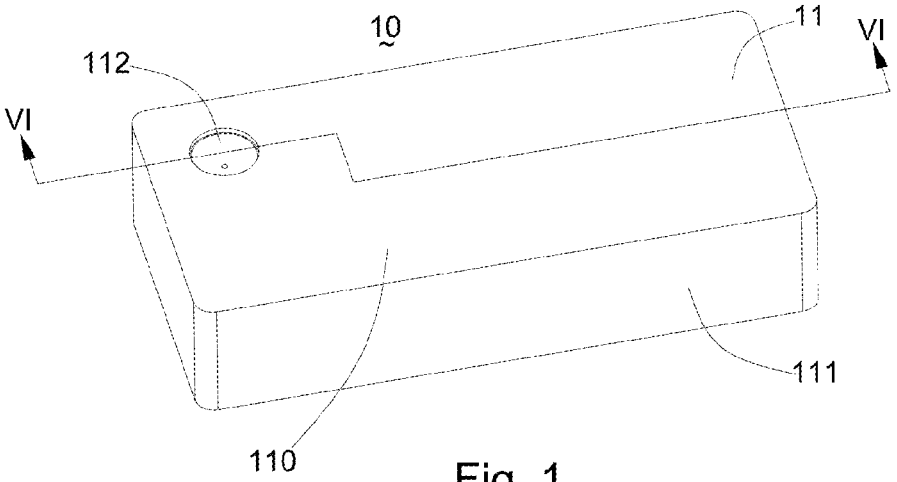
FIG. 1 is an isometric view of a speaker box in accordance with an embodiment of the present disclosure.
Figure 2:
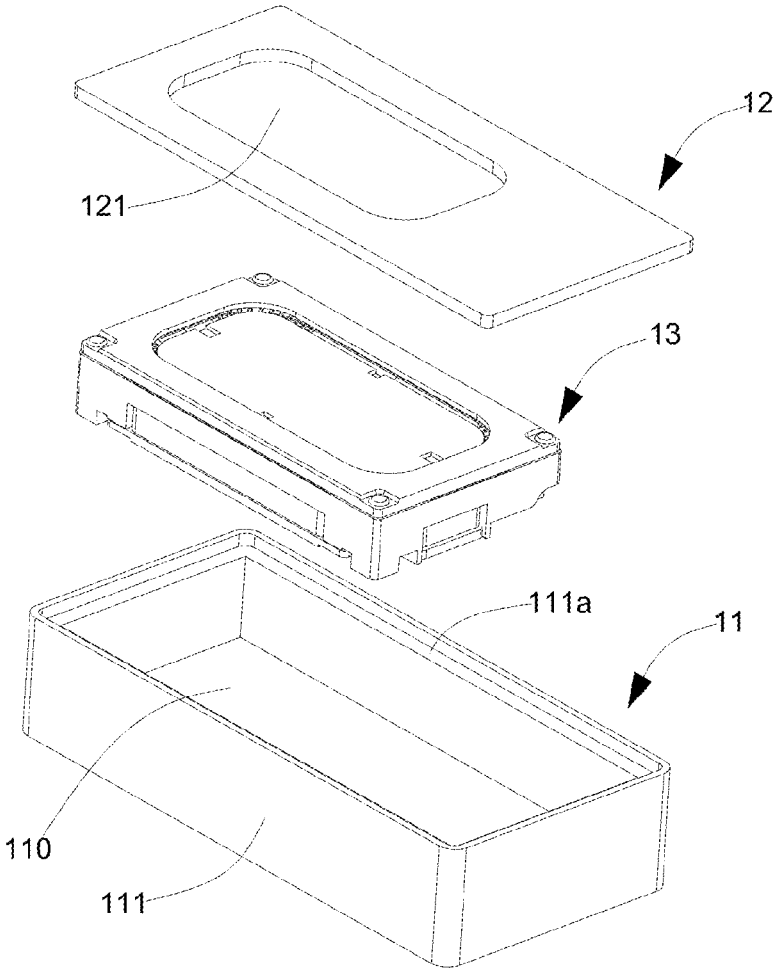
FIG. 2 is an exploded view of the speaker box in FIG. 1.

Referring to FIG. 1, a speaker box 10 in accordance with an exemplary embodiment of the present disclosure may be used in an electronic device, such as a mobile phone, a laptop computer, or a tablet computer, for converting electric signals into audible sounds, such as voices or music. Generally, a speaker box has a relatively large back volume, which can improve the low frequency sound performance. Referring to FIGS. 1-2, the speaker box 10 includes a housing 11, a cover 12 forming a receiving room cooperatively with the housing 11, and a speaker unit 13 accommodated in the receiving room. The housing 11 comprises a bottom 110 bounded by a plurality of sides 111. A leaking hole 112 is arranged in the bottom 110. The side 111 of the housing 11 further includes a step 111*a* for carrying the cover 12. The cover 12 includes an acoustic hole 121 for transmitting the sounds generated by the speaker unit 13.

Figure 3:
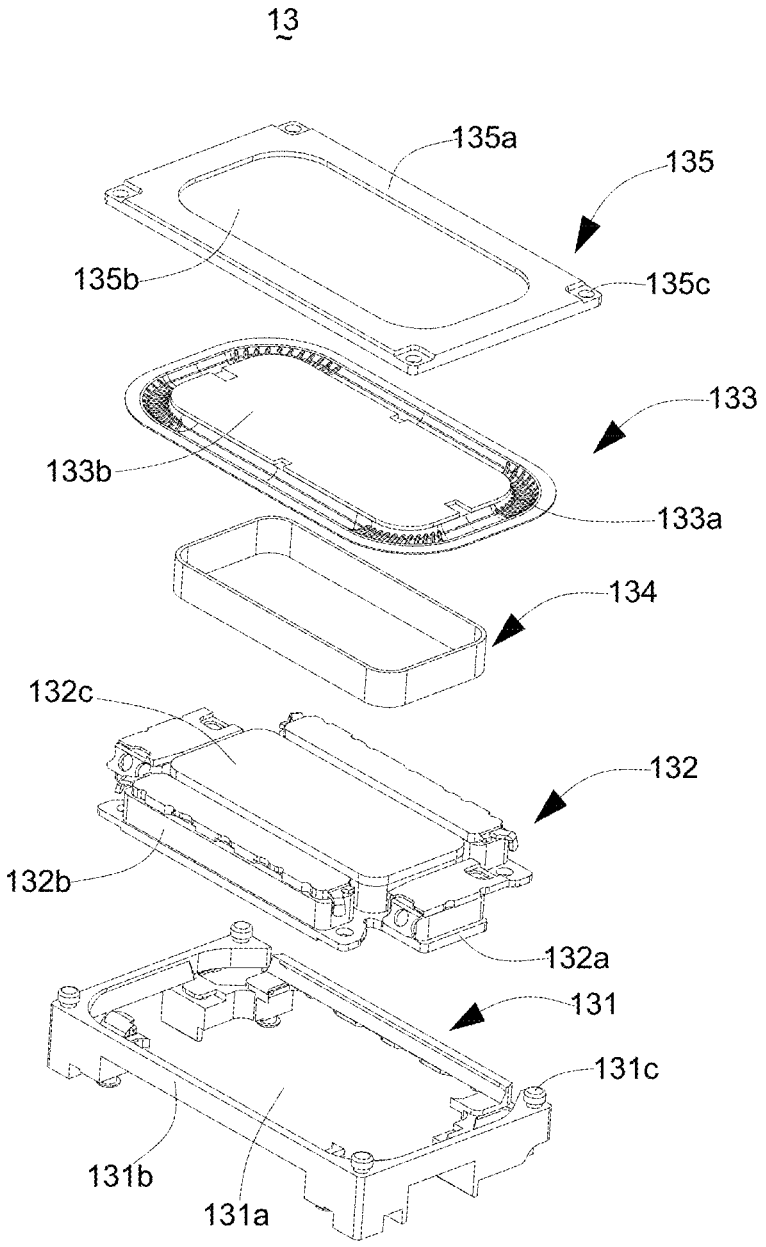
FIG. 3 is an exploded view of a speaker unit of the speaker box in FIG. 1.

Referring to FIG. 3, the speaker unit 13 is accommodated in the receiving room formed by the cover and the housing for converting electrical signals into audible sounds. The speaker unit 13 includes a frame 131, a magnetic circuit unit 132 supported by the frame 131, a diaphragm 133 for radiating sound waves, a voice coil 134 connected to the diaphragm for driving the diaphragm to vibrate along a vibrating direction, and a lid 135 disposed above the diaphragm 133. The frame 131 includes a receiving space 131*a* formed by a plurality of sidewalls 131*b* for accommodating the magnetic circuit unit 132. The sidewall 131*b* of the frame 131 further comprises a plurality of first protrusions 131*c*.

The magnetic circuit unit 132 includes a lower plate 132*a*, at least one magnet 132*b* positioned on the lower plate 132*a*, and at least one upper plate 132*c* attached to a top of the at least one magnet 132*b*. The lower plate 132*a*, the at least one magnet 132*b*, and the at least one upper plate 132*c* cooperatively form a magnetic gap 132*d* (see FIG. 6).

The diaphragm 133 includes a membrane 133*a* supported by the sidewall 131*b* of the frame 131, and a dome 133*b* attached to the membrane 133*a*. The voice coil 134 is the coil of wire attached to the diaphragm 133 for providing motive force to the diaphragm 133 by the reaction of a magnetic field to the current passing through it. The lid 135 has a ring 135*a* which forms a sound hole 135. Corresponding to the first protrusions 131*c* of the frame 131, the lid 135 further includes a plurality of first positioning holes 135*c* at corners of the ring 135*a*.

Figure 4:
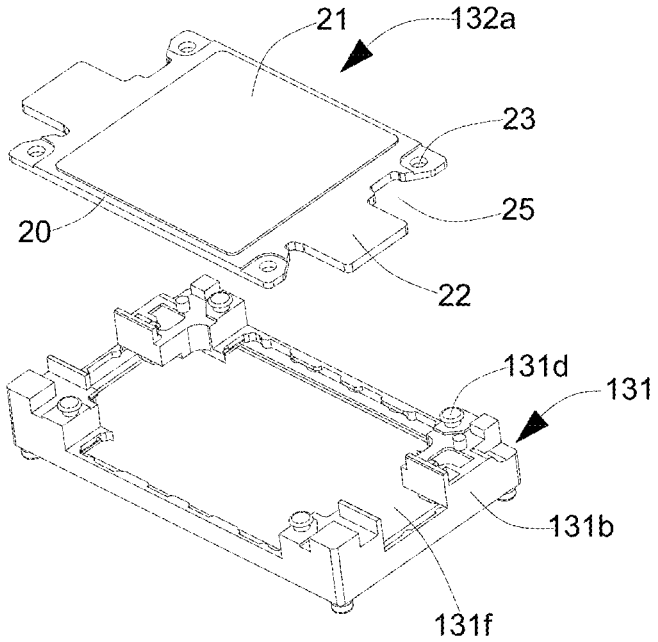
FIG. 4 is an isometric view of a lower plate ready to be mounted to a frame of the speaker unit, from an aspect adverse to the aspect of FIG. 3.
Figure 5:
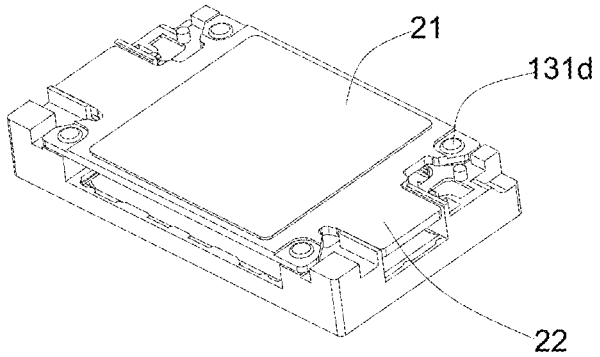
FIG. 5 is an isometric assembled view of FIG. 4.

Referring to FIG. 4, from an aspect adverse to the aspect of FIG. 3, the sidewall 131*b* of the frame 131 comprises a plurality of second protrusions 131*d* on the other side thereof opposed to the first protrusions 131*c* (see FIG. 3), and a pair of slots 131*f*. The lower plate 132*a* includes a main body 20, a thickened portion 21 extending from the main body away from the at least one magnet 132*b*, and a pair of projections 22 extending from and coplanar with the main body 20. The projection 22 forms an interval 25 cooperatively with the main body 20. Corresponding to the second protrusions 131*d* of the frame 131, the lower plate 132*a* includes a plurality of positioning holes 23. Referring to FIG. 5, while assembled, the second protrusions 131*d* engage with the second positioning holes 23, and the projections 22 engage with the slots 131*f*, by which the lower plate 132*a* is firmly assembled with the frame 131.

Figure 6:
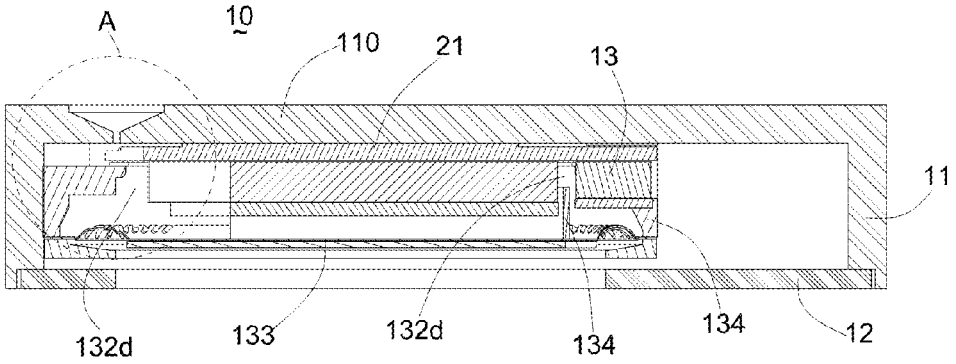
FIG. 6 is a cross-sectional view of the speaker box taken along line VI-VI in FIG. 1.

Referring to FIG. 6, the speaker unit 13 is accommodated in the receiving room formed by the housing 11 and the cover 12, with the thickened portion 21 of the lower plate abutting against the bottom wall 110 of the housing 11. The voice coil 134 is partially received in the magnetic gap 132*d*, and the diaphragm 133 is suspended by the frame 131 and driven by the voice coil 134.

Figure 7:
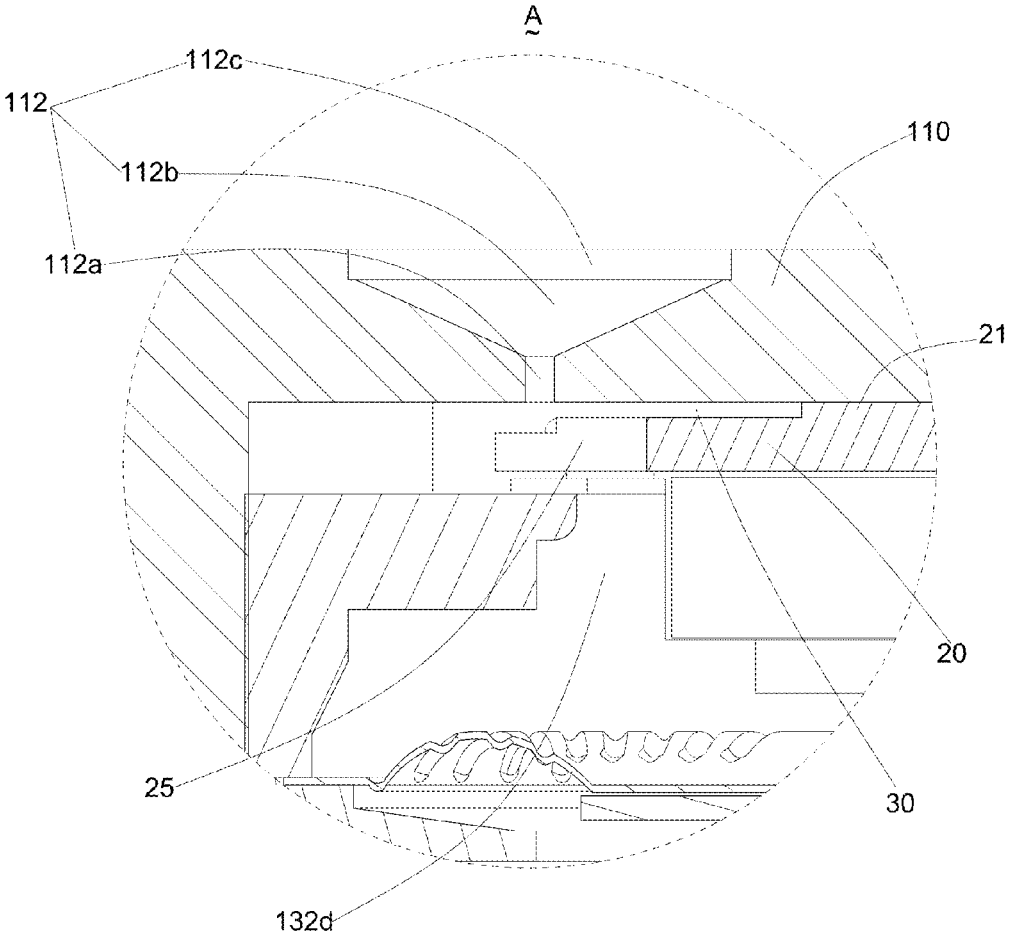
FIG. 7 is an enlarged view of Part A of FIG. 6.

Referring to FIG. 7 which is an enlarged view of Part A in FIG. 6, the leaking hole 112 in the bottom wall 110 includes a first hole 112*a* with an opening communicating with the receiving room, a second hole 112*b* in a middle portion of the bottom wall 110, and a third hole 112*c* with an opening communicating with the outside of the speaker box. In this embodiment, the second hole 112*b* is cone-shaped with a bigger opening communicating with the third hole 112*c* and a smaller opening communicating with the first hole 112*a*. Wholly, the leaking hole 112 is substantially funnel-shaped. The thickened portion 21 of the lower plate abuts against the bottom wall 110 thereby forming a space 30 cooperatively with the main body 20 and the bottom wall 110. The space 30 communicates with the magnetic gap 132*d* via the interval 25, and communicates with the leaking hole 112, by which the magnetic gap 132*d* is communicated with the outside of the speaker box for balancing the air pressure in the magnetic gap during the vibration of the diaphragm. Alternatively, if the bottom wall 110 has no leaking hole 112, the space 30 may be communicated with the magnetic gap 132*d* via the interval 25, which could enlarge the back volume of the speaker unit and further improve the low frequency sound performance.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a housing including a bottom wall and a plurality of sides bounding the bottom wall;

a cover forming a receiving room cooperatively with the housing;

a speaker unit accommodated in the receiving room, the speaker unit comprising, a frame having a receiving space and a plurality of sidewalls forming the receiving space;

a magnetic circuit unit having a lower plate, a magnet positioned on the lower plate, an upper plate attached to the magnet, and a magnetic gap, the lower plate having a main body and a thickened portion;

a diaphragm supported by the frame; and a voice coil partially received in the magnetic gap for driving the diaphragm;

wherein the thickened portion abuts against the bottom wall for forming a space between the thickened portion and the main body, and the space communicates with the magnetic gap.

2. The speaker box as described in claim 1, wherein the bottom wall of the housing includes a leaking hole communicating with the space.

3. The speaker box as described in claim 2, wherein the leaking hole includes a first hole with an opening communicating with the receiving room, a second hole in a middle portion of the bottom wall, and a third hole with an opening communicating with the outside of the speaker box.

4. The speaker box as described in claim 3, wherein the second hole is cone-shaped with a bigger opening communicating with the third hole and a smaller opening communicating with the first hole.

5. The speaker box as described in claim 1, wherein the lower plate further comprises a projection coplanar with the main body thereof for forming an interval with the main body, the interval being communicating with the magnetic gap.

6. The speaker box as described in claim 5, wherein the sidewall of the frame includes a slot corresponding to the projection of the lower plate for engaging with the projection.

7. The speaker box as described in claim 1, wherein the speaker unit further includes a lid having a plurality of first positioning holes, and the sidewall of the frame further includes a plurality of first protrusions engaging with the first positioning holes.

8. The speaker box as described in claim 1, wherein the lower plate further includes a plurality of second positioning holes, and the sidewall of the frame further includes a plurality of second protrusions engaging with the second positioning holes.

9. The speaker box as described in claim 1, wherein the side of the housing comprises a step for carrying the cover thereon.

10. A speaker box, comprising:

a housing including a bottom wall;

a speaker unit accommodated in the housing, the speaker unit comprising a magnetic circuit unit having a lower plate, a magnet on the lower plate, an upper plate on the magnet, and a magnetic gap, the lower plate abutting against the bottom wall;

the lower plate including a main body keeping a distance from the bottom wall and a thickened portion abutting against the bottom wall;

a space formed cooperatively by the main body, the thickened portion and the bottom wall of the housing, the space being communicated with the magnetic gap.

11. The speaker box as described in claim 10, wherein lower plate further includes a projection coplanar with the main body, and an interval formed by the projection and the main body, the interval communicating the magnetic gap.

* * * * *